US006393722B1

(12) United States Patent
Chardine

(10) Patent No.: US 6,393,722 B1
(45) Date of Patent: May 28, 2002

(54) CHAMBER AND INSTALLATION FOR DRYING ANIMAL WASTE

(75) Inventor: Raymond Chardine, Lamballe (FR)

(73) Assignee: Industries Agrigesco Inc., Province de Quebec (CA)

( * ) Notice: Subject to any disclaimer, the term of this patent is extended or adjusted under 35 U.S.C. 154(b) by 0 days.

(21) Appl. No.: 09/890,246

(22) PCT Filed: Feb. 2, 2000

(86) PCT No.: PCT/FR00/00238

§ 371 Date: Aug. 2, 2001

§ 102(e) Date: Aug. 2, 2001

(87) PCT Pub. No.: WO00/46560

PCT Pub. Date: Aug. 10, 2000

(30) Foreign Application Priority Data

Feb. 2, 1999 (FR) ..... 99 01411

(51) Int. Cl.[7] ..... F26B 11/12

(52) U.S. Cl. ..... 34/181; 34/95; 34/95.1; 34/179; 34/201; 34/236

(58) Field of Search ..... 34/95, 95.1, 179, 34/181, 182, 183, 201, 236; 119/57.6

(56) References Cited

U.S. PATENT DOCUMENTS 3,697,056 A * 10/1972 Prins, Sr. ..... 432/130
3,982,499 A * 9/1976 Frankl ..... 119/450

FOREIGN PATENT DOCUMENTS

| | | |
|---|---|---|
| DE | 31 04 206 | 2/1981 |
| DE | 29049 | 4/1984 |
| EP | 0 820 695 | 1/1998 |
| EP | 0 836 586 | 5/1999 |

* cited by examiner

*Primary Examiner*—Ira S. Lazarus
*Assistant Examiner*—Kathryn S. O'Malley
(74) *Attorney, Agent, or Firm*—Armstrong, Westerman & Hattori, LLP

(57) ABSTRACT

The invention concern a chamber for drying animal waste, in particular poultry manure, adapted to receive a mixture (M) of fresh waste and dry waste, the floor thereof being adapted to retain the mixture (M) while being permeable to air (A), said floor consisting of an assembly of elements (60, 60') each capable of forming means for retaining the waste and including means (T) which periodically enable to transfer outside the chamber (1) and through said floor (6) a fraction of the dry waste. The invention is characterised in that said elements consist of two series of horizontal crosspieces (60, 60') arranged along two superposed parallel planes ($P_1$, $P_2$), said crosspieces (60,60') being arranged such that the floor (6) contains gaps in the vertical direction, and said transfer means (T) consist of at least a sliding drawer horizontally mobile between said two planes ($P_1$, $P_2$) of crosspieces (T), the longitudinal movement of said drawer, capable of sweeping the entire surface of said floor from one end to the other, driving the waste accumulated on said crosspieces (60') of the lower plane ($P_2$) such that they drop by gravity outside the chamber. The invention also concerns a drying installation equipped with such a chamber.

17 Claims, 4 Drawing Sheets

CHAMBER AND INSTALLATION FOR DRYING ANIMAL WASTE

The present invention relates to a chamber and an installation for drying animal excrement, notably poultry droppings.

On account of their high water content, a large number of techniques for drying poultry droppings have already been proposed, the main aim of which is to obtain a dehydrated and deodorized product, easily usable for subsequent applications. A main application is that of fertilizer.

The simplest method consists of blowing air, inside the rearing buildings, above endless belt conveyors which are disposed under the rearing cages and on to which the poultry excrement falls. However, the air becomes only partially laden with moisture, owing to its rapid passage in contact with the thin layer of droppings spread on the conveyors. In order to obtain better efficiency, it would be necessary to use very large volumes of air and provide turbulence within said air, which is very expensive in terms of energy.

In certain cases, this type of method is used within drying tunnels, outside the rearing buildings. The major drawbacks of this type of installation lie in its size and mechanical complexity.

Document EP-B-0 210 196 describes a method and an installation for drying and conditioning chicken manure. The method comprises a step of microbiological conversion of the manure, which necessitates having to closely monitor all the conversion parameters, in order to be certain of ensuring good drying of the manure. Moreover, the corresponding installation is necessarily complex and expensive.

Document U.S. Pat. No. 2,679,114 relates to equipment and a method for the conversion and composting of manure. The equipment comprises a conveyor which transports the raw manure to the upper part of a silo. The base of the silo is formed from two perforated and convergent partitions between which a channel extends. At the base of the channel there is provided a conveyor disposed in a chute. Above the conveyor there extend two parallel rotary shafts provided with blades. Rotational driving of the shafts causes transfer of some of the manure on to the conveyor.

Air under pressure, possibly laden with moisture, is introduced into the mass of manure, through the lower part of the silo, to provide the conversion thereof. The air circulates backwards with respect to the manure, which contributes towards improving the drying or conversion thereof.

Document DE-A-2723581 concerns a method and an installation for aerobic decomposition of organic solids. The installation comprises equipment for pre-drying the material, a storage chamber and a silo for the treated dry product. This chamber and this silo communicate through their bases with a twin-screw conveyor which produces an intimate mixture of the pre-dried product and the dry product.

This mixture is then transferred into a movable-base decomposition reactor, via a vertical conveyor. The mixture can be selectively directed to a drying tower and the final product is stored in the aforementioned silo.

It should be noted that the movable base, as in the previous document, is composed of an assembly of rotary shafts, the periphery of which is provided with fingers or blades.

This type of movable base permeable to air has serious drawbacks.

This is because, when the dried excrement gathers in the form of lumps resembling lumps of earth, this is a particularly hard material. The driving power for the rotating shafts must be particularly high in order to succeed in breaking up the lumps and make them pass into the gaps located between the fingers or blades of two adjacent shafts. Such an increase in power is expensive in terms of energy.

Furthermore, when the shafts are at rest, that is to say not activated rotationally, the aforementioned gaps inevitably allow filtering of the most fluid fraction of the dried material, which is undesirable.

Finally, there is known through the document WO-A-97/02222 an installation for drying animal excrement, comprising a chamber, the base of which is also movable and permeable.

This base is formed from a number of elements consisting of articulated extrusions, capable of swinging simultaneously in order to enable the flow of a fraction of excrement.

This type of installation is satisfactory as regards operation. However, the swinging manoeuvre requires a considerable consumption of energy.

The present invention aims to overcome these drawbacks.

More precisely, it aims to provide an inexpensive drying installation of simple design, which makes it possible to efficiently dry poultry droppings using a reduced volume of air. It aims to achieve this objective using little energy, while recovering the air used with a high degree of saturation in terms of moisture.

Furthermore, it aims to provide an installation in which the movable base permeable to air does not have the drawbacks described above.

According to a first aspect of the invention, this concerns an installation for drying animal excrement, which is adapted to receive a mixture of fresh excrement and dry excrement, the base thereof being provided for holding the mixture while being permeable to air, this base consisting of an assembly of elements each capable of forming a means of holding excrement and having means which make it possible, periodically, to transfer a fraction of dry excrement out of the chamber and through this base.

It is characterised principally by the fact that said elements consist of two series of horizontal crosspieces organized in two superposed parallel planes, these crosspieces being disposed in such a way that the base has no interruption of continuity in the vertical direction, and by the fact that said transfer means consist of at least one slide movable horizontally between these two planes of crosspieces, the longitudinal movement of this slide, capable of sweeping the whole of the surface of said base from one end to the other, pushing the excrement accumulated on the top of the crosspieces of the lower plane, so that it falls by gravity out of the chamber.

Thus, "the permeable base" has only one single type of moving part, namely the slide or slides. This makes it possible to greatly simplify the structure of the chamber and reduce the consumption of energy devoted to moving the slide.

Furthermore, according to other advantageous and non-limitative characteristics of this installation:

- seen from the side, the crosspieces are disposed in staggered rows, the edges of the crosspieces of the upper plane partially overlapping the crosspieces of the lower plane;
- the crosspieces of the upper plane are perforated;
- the chamber has two slides of rectangular form, the width of which is equal to half that of the base, and these two slides are movable in opposite directions;

the means of activating said slides consist of a first cable which connects their transverse edges directed from one and the same side, this cable passing over a series of pulleys, at least one of which is a driving pulley, and a second cable which connects their transverse edges opposite to the first ones, this cable passing over a series of return pulleys, so that, by activation of the driving pulley, one of the slides moves in one direction, while the second moves in the opposite direction;

they comprise means capable of always placing the two ends of the first cable, respectively attached to the first slide and the second slide, under tension;

it has a carriage movable longitudinally, capable of receiving said mixture and distributing it uniformly over said base;

said carriage bears a series of fingers directed downward, capable of levelling the layer of mixture discharged on said base;

said series of fingers can be retracted at the end of the chamber.

The invention also concerns an installation for drying animal excrement.

It is characterised essentially by the fact that it comprises:

means for mixing fresh excrement with dry excrement;

a drying chamber in accordance with one or other of the aforementioned characteristics;

means of blowing air into said chamber, through said base.

Other characteristics and advantages of the invention will emerge from a reading of the detailed description which follows of a preferential but non-limitative embodiment. This description will be given with reference to the accompanying drawings in which:

FIG. 5 is a top view of the means of activating the movable slides with which the chamber is equipped;

Figure 1:
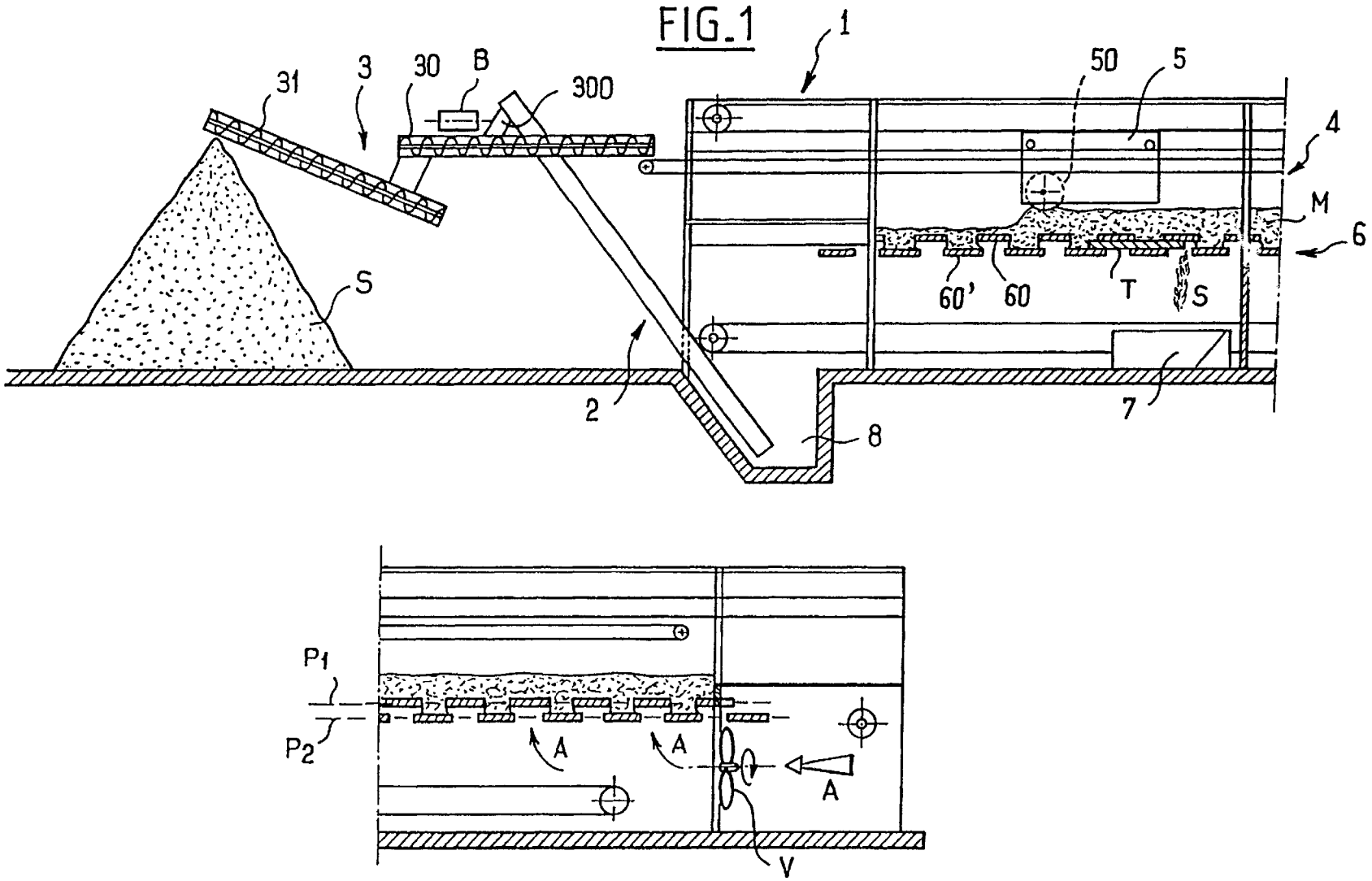
FIG. 1 is a highly schematic presentation of an installation including a chamber in accordance with the invention, designed to show the different elements composing it, the lower part of the figure normally being continuous with the upper part.

The installation depicted in FIG. 1 comprises essentially a drying chamber 1, an assembly of Archimedes screw conveyors 2 and 3, a fresh excrement feed conveyor B, and means of blowing air A into the chamber 1.

As will be seen later, the underneath of the chamber 1 is provided with a receiving pit 8 for dry excrement S, into which the upstream end of the Archimedes screw conveyor 2 dips; its downstream end, which extends out of the chamber 1, overhangs a first section 30 of a second Archimedes screw 3.

This first section has two directions of rotation, a first direction where the screw it contains directs the matter towards the chamber 1 and a second direction where the screw directs the matter in the opposite direction.

A chute 300 links the conveyor 2 with the section 30. The latter is furthermore open in proximity to the chute 300, this opening being located exactly straight below a fresh excrement feed moving belt conveyor B.

Furthermore, the downstream end of the section 30 communicates with the upstream end of a second section 31, also having an Archimedes screw. This screw has only one direction of rotation and is capable of directing the matter towards its open downstream end, opposite to the first section.

Thus, if the Archimedes screws of the sections 30 and 31 are activated in the same direction (by driving means, not depicted), the dry excrement taken from the pit is discharged into a heap S.

Assuming that the screw of the section 30 is activated in the opposite direction, the second section is made inoperative and the conveyor B is started. There then takes place in the section 30 an intimate mixing M of fresh and dry excrement which will be directed into the chamber 1, as will be seen below.

The drying chamber 1 has the form of an elongated right-angled parallelepiped and is open at its top.

It is provided in its upper part, in proximity to one of its longitudinal and vertical walls, with a moving belt conveyor 4, the upper and lower belts of which extend horizontally, parallel to one another.

This conveyor has a single direction of rotation; this direction is such that its upper belt moves from left to right, when considering FIG. 1. Its upstream end is situated slightly outside the chamber 1 and is overhung by the downstream outside of the Archimedes screw section 30.

Figure 4:
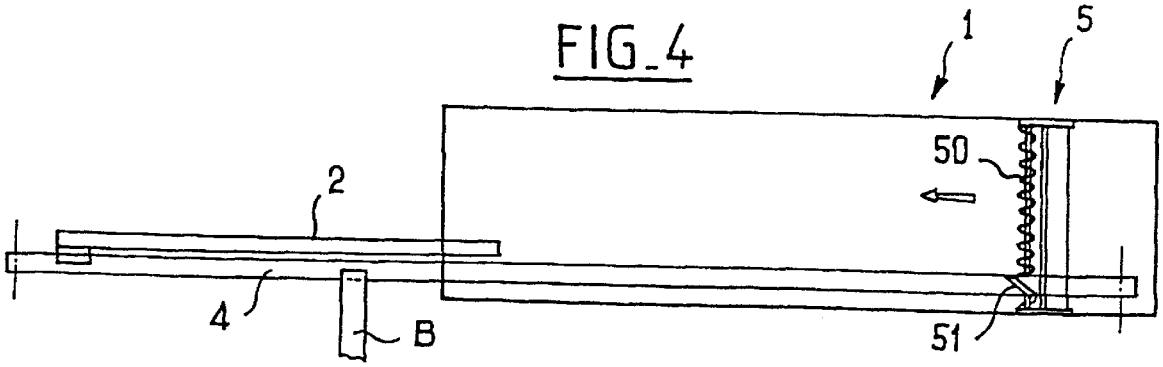
FIG. 4 is a simplified top view of the chamber, with its excrement supply means.

As shown in FIG. 4, the conveyor 4 occupies a tiny part of the width of the chamber.

The chamber is also provided, in its upper part, with a movable carriage 5 in the form of a casing, guided in longitudinal translational motion by rollers 55 resting on guide paths provided in the longitudinal walls of the chamber.

This carriage is provided with a scraper blade 51 which rests on the upper belt of the conveyor 4. It is also equipped with an Archimedes screw 50, with a horizontal and transverse axis of rotation, which is situated in a plane located below that of the lower belt of the conveyor 4. The base of the trough in which it moves is open in part.

As will be seen later, the faeces received by the conveyor 4 are scraped by the blade 51, discharged into the carriage 5 and distributed over the whole width of the chamber by the screw 50.

Electrical or electronic means, not depicted, for example having a photoelectric cell, make it possible to make the carriage advance automatically, as soon as the presence of excrement is detected in the Archimedes screw.

The base of the chamber 1 is generally referenced 6 and fits into a rectangle.

It is composed of two series of crosspieces 60 and 60', disposed horizontally and organized as two superposed parallel planes $P_1$ and $P_2$. The arrangement of the crosspieces is such that the base 6 has no interruption of continuity in the vertical direction. In other words, this means that, seen from above or below, the base gives the impression of being composed of one and only one continuous plate. The projection of the base on a horizontal plane therefore forms a continuous surface (devoid of openings).

The crosspieces are generally flat, not very thick, and have a rectangular section. They are for example made of metal.

Figure 2:
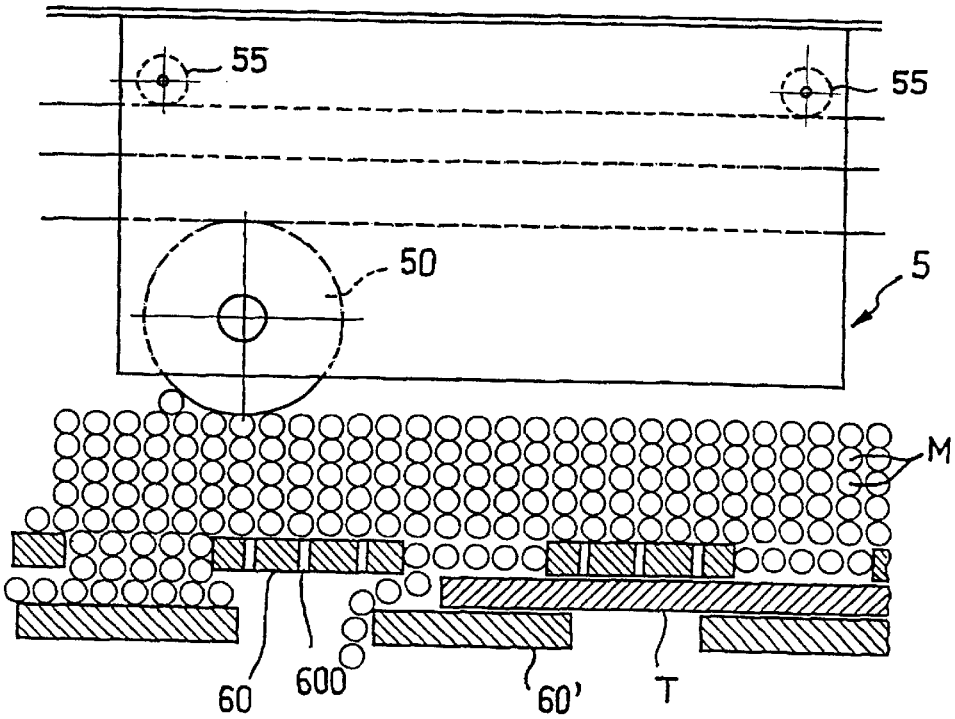
FIG. 2 is a side view of the means which make it possible to supply, with excrement, the chamber according to the invention, its base being cut through a longitudinal vertical plane.
Figure 3:
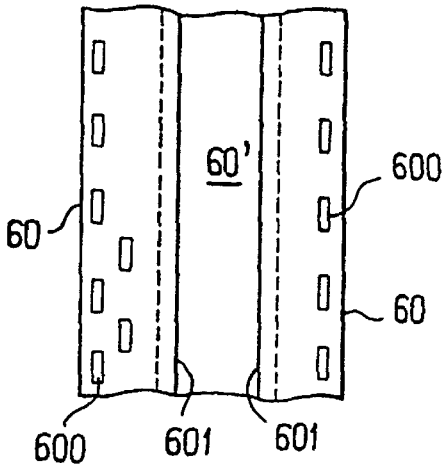
FIG. 3 is a partial top view of crosspieces which make up the permeable base of the chamber.

As shown more particularly in FIGS. 2 and 3, the crosspieces 60 of the upper plane $P_1$ are disposed so that their transverse edges 601 partially overhang the crosspieces 60' of the lower plane $P_2$.

The crosspieces 60 of the upper plane $P_1$ are provided with oblong openings 600, disposed transversely. The importance of such a characteristic will be explained later in the description.

In the space which separates the two planes $P_1$ and $P_2$ of crosspieces 60 and 60', at least one horizontally movable slide T is present. This is a plate of small thickness and rectangular form, the width of which corresponds to that of the base. This slide has the function, as will be seen below, of pushing the excrement which has accumulated on the crosspieces 60' of the lower plane so as to clear it out of the chamber.

It is capable of sweeping the whole of the surface of the base, from one end to the other.

Figure 6:
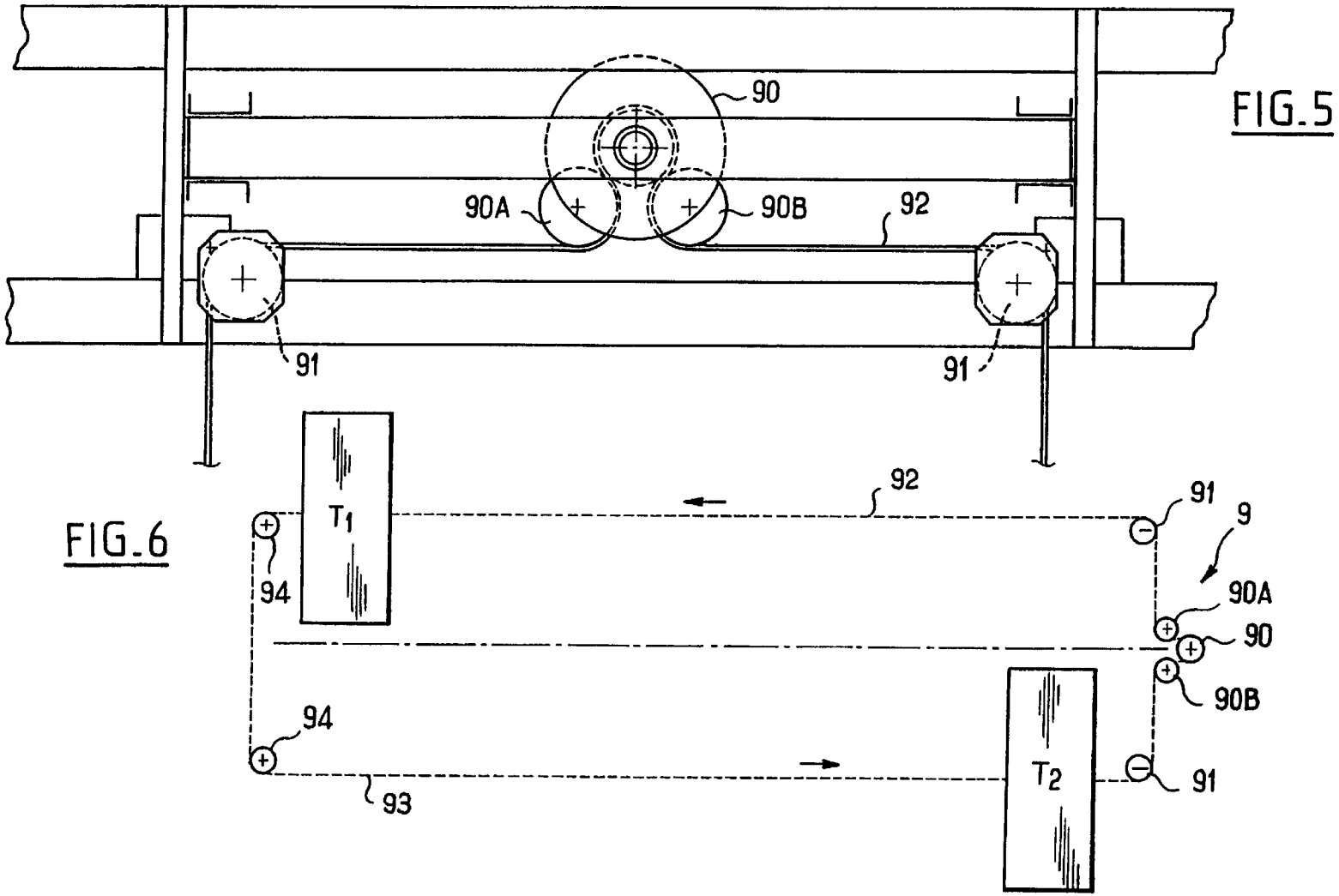
FIG. 6 is a general top view of these slides, with their activating cable and return pulleys.

In the embodiment of FIG. 6 which corresponds to one particularly advantageous solution, the chamber is equipped with two slides $T_1$ and $T_2$, in the form of rectangular plates, the width of which corresponds substantially to half that of the chamber.

These slides are equipped with means making it possible to move them in longitudinal translational motion between the two planes of crosspieces, one moving in one direction, while the other moves in the opposite direction.

To do this, each slide is attached by one of its transverse faces to the end of a first cable 92 which cooperates with a series of return pulleys which have the general reference 9.

More precisely, with reference to FIG. 5, there is disposed, in the longitudinal median axis of the chamber, a master pulley 90, the axle of rotation of which, disposed vertically, is driven by means of a motor, not depicted. This is a grooved pulley, with an advantageously trapezoidal profile. This pulley is associated with two secondary pulleys 90A and 90B so that the progress of the cable 92 over these three pulleys gives it substantially the form of the Greek letter omega (Ω).

The system is also equipped with a second pair of return or corner pulleys 91, each being disposed substantially along the longitudinal median axis of the slides $T_1$ and $T_2$.

As for the transverse faces of the slides opposite to the previous ones, these are connected by a second cable 93 which cooperates with a pair of return or corner pulleys 94 disposed along the longitudinal median axis of the slides $T_1$ and $T_2$.

The four corner pulleys 91 and 94 are disposed at the corners of an imaginary rectangle, along the large sides of which the slides are caused to be moved.

It should be understood that activation of the pulley 90 in one direction or the other will result in movement of the slide $T_1$ in one direction and, simultaneously, of the slide $T_2$ in the opposite direction.

Figure 7:
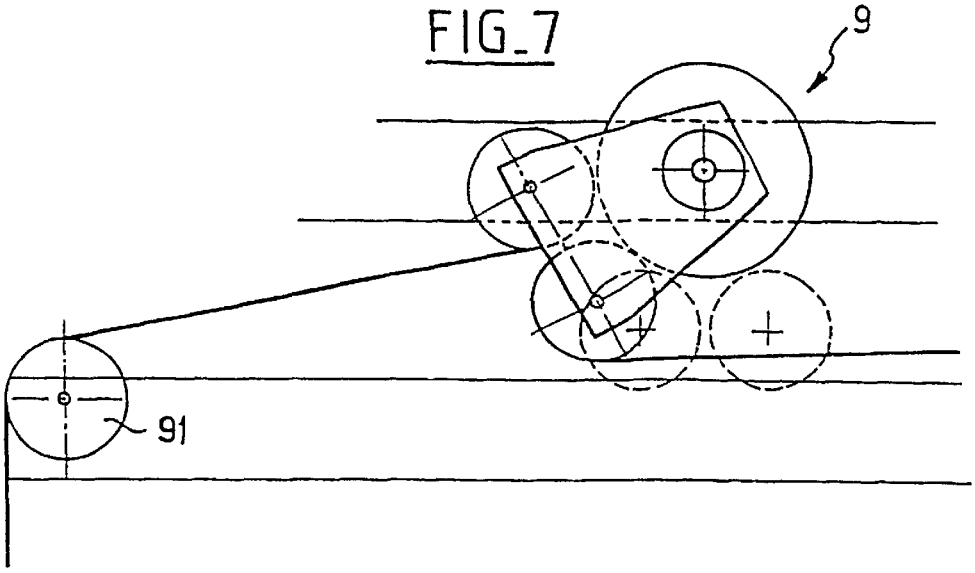
FIG. 7 is a detail view of these pulleys and the activating cable.

In order to avoid jerks in the operation, due to the fact that the end of cable 92 which corresponds to the non-drawn slide is slack or loose, provision is made, as illustrated in FIG. 7, that the two pulleys 90A and 90B are immovably attached to a clamp, itself immovably attached to the master pulley 90.

Thus, depending on the force exerted on the cable, the assembly of pulleys 90, 90A and 90B is oriented in the direction of the so-called slack cable end, in order to place it under tension.

This system makes it possible to dispense with continuous monitoring of the correct operation of the system.

Of course, when the slides $T_1$ and $T_2$ each reach one end of the chamber 1, the motor activating the pulley 90 is then controlled so that its direction of rotation is reversed. End-of-travel detectors can be used to do this.

Of course, the material of the cables must be chosen to be sufficiently strong. They can for example be plastic-coated steel cables.

Figure 8:
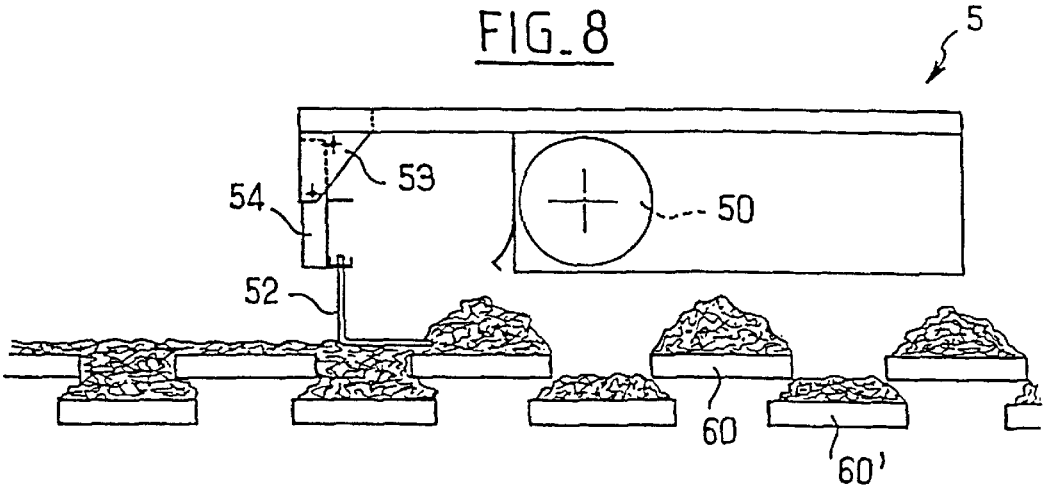
FIG. 8 is a side view of the carriage for supplying the chamber with excrement, equipped with a series of levelling fingers.

With reference to FIG. 8, this illustrates the excrement supply carriage with, at its front part, a swinging vertical arm 54, the lower end of which is provided with a series of bent fingers 52 directed towards the base and at an angle, in the direction of the excrement.

The function of these fingers is to uniformly distribute the excrement over the crosspieces so as to avoid it accumulating on the crosspieces of the upper plane, to the detriment of the lower plane.

Figure 9:
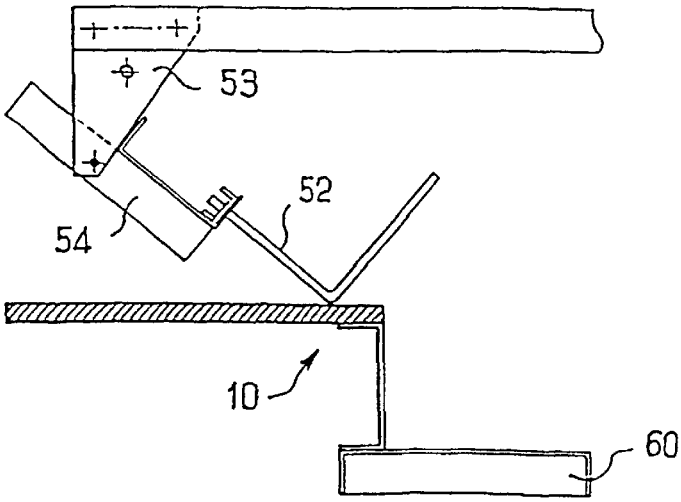
FIG. 9 is a detail view of one of these fingers, in the retracted position.

As shown in FIG. 9, this finger system is provided swinging with respect to a connecting piece 53 so that, at the end of the chamber 10, said finger system retracts. This allows the carriage 5 to move right to the base of the chamber, without being hindered by the fingers.

Below the base 6 there is provided a scraper system 7 of known type, which, as will be seen later, is designed to bring back to the pit 8 the dry excrement which has passed through the permeable base 6. In one particular embodiment, a number of scrapers can be provided.

Finally, the installation is provided with means of taking in air A coming for example from a rearing building situated in proximity to the installation.

This air is taken in from the underside of the base and forced to pass through said base from bottom to top, for example by means of fans V.

The way in which the installation and chamber of the invention are used will now be described, with reference to the accompanying drawings.

In a preliminary step, fresh excrement, for example droppings, is mixed with dry droppings so as to produce a loose mixture M, permeable to air. The aim of this phase is to obtain a product which is easy to handle, as opposed to a mass of fresh droppings which constitutes a semi-liquid product, much more difficult to handle and treat.

To do this, the fresh droppings are transported by the moving belt conveyor B into the aforementioned conveyor section 30.

An intimate mixture of these two products is made inside the screw of the conveyor and the whole is discharged on to the moving belt conveyor 4 provided in the upper part of the chamber 1.

The movement of the carriage 5 with respect to the belt 4 causes a discharge of the mixture and the transfer thereof inside the chamber on to the base 6. As a guide, the mixture M comprises for example around 50% by weight of dry matter.

Care will have been taken, prior to the discharge, of starting the means of blowing air A, so that said air rises inside the chamber 1, passing as a matter of priority through the spaces located between the crosspieces 60 and 60'. A fraction of the air also flows out by passing through the openings 600 of the crosspieces 60.

As it progresses from the base to the top of the chamber, the air becomes laden with moisture (up to around 95%) and progressively dries out the mixture M of droppings.

It is of course the layer of mixture closest to the base 6 which is dried first.

Periodically, the motor of the pulley 90 is activated so that the slides $T_1$ and $T_2$ undergo a translational movement in the reverse direction between the two planes of crosspieces 60 and 60'.

During this manoeuvre, the fraction of dry excrement which has accumulated on the top of the crosspieces 60' is pushed and falls by gravity on to the ground present at the lower part of the chamber.

The presence of oblong holes 600 in the crosspieces of the upper plane $P_1$ has the aim of accelerating the drying of the fraction of droppings which has accumulated there since, in this area, the droppings do not as a matter of priority have the flow of air A passing through them.

Each transfer of a fraction of droppings through the permeable base 6 results in the creation of cones of matter above the crosspieces 6 of the upper plane. It is to avoid this phenomenon that levelling fingers 52 have been provided on the carriage 5. In this way, the layer of droppings on the base 6 is continuously levelled.

The scraper 7 is periodically set into action by a cable system, so as to transfer the dry droppings into the receiving pit 8. Here, they are recovered by the Archimedes screw conveyor 2 and transferred, either in full into a heap S with a view to subsequent use, or mixed in part with a new arrival of fresh droppings.

It is quite evident that the whole of this process is implemented continuously, fractions of dry droppings being extracted from the chamber regularly. Means allowing automatic measurement of the hygrometry of the droppings can be fitted, slightly above the movable base.

In one embodiment, not depicted, the slides are formed from a frame consisting of a welded assembly of four extrusions, namely two longitudinal extrusions and two transverse extrusions, the internal space they delimit being empty.

In this case, it is the vertical faces of the two transverse extrusions which push the excrement which has accumulated on the lower crosspieces 60' of the base 6. Preferably, the spacing between the two transverse extrusions will be chosen greater than the spacing between two adjacent crosspieces. For example, it can be 75 cm, the spacing between two crosspieces being 50 cm. In this way, when one of the extrusions is pushing excrement, the other is inactive, and vice versa. This makes it possible to delimit the power necessary for moving the slides.

Assuming that the slide width is two meters, each extrusion, each time it "sweeps" a crosspiece, moves a surface area of around 1 $m^2$ of droppings (0.5 m×2 m).

The spacing between the two planes of crosspieces is for example of the order of 25 mm.

Consequently, the amount of dry excrement removed each time a slide passes across is not very great.

The technique according to the invention therefore makes it possible to regularly recover, using simple means and consuming little energy, a regular, not very great, and uniform layer of dry droppings, that is to say one within which the moisture level is the same throughout.

Furthermore, in order to carry out this work, it is necessary to develop a tractive force on the cable 92 of the order of 400 kg, which corresponds to a power of the order of 750 watts.

Assuming a base surface area of the order of 200 $m^2$, if it were necessary to move 200 slides each capable of sweeping a surface area of one $m^2$, the corresponding power to be developed would be 150 kilowatts (0.750×200).

Finally, although the present invention has been described with reference to poultry droppings, other types of excrement can also be treated.

What is claimed is:

1. Chamber for drying animal excrement, notably poultry droppings, which is adapted to receive a mixture of fresh excrement and dry excrement, the base thereof being provided for holding the mixture while being permeable to air, said base consisting of an assembly of elements each capable of forming a means of holding excrement and having transfer means which make it possible, periodically, to transfer a fraction of dry excrement out of the chamber and through said base, wherein said elements consist of two series of horizontal crosspieces organized in two superposed parallel planes, said crosspieces being disposed in such a way that the base has no interruption of continuity in the vertical direction, and by the fact that said transfer means consist of at least one slide movable horizontally between said two planes of crosspieces, the longitudinal movement of said slide, capable of sweeping the whole of the surface of said base from one end to the other, pushing the excrement accumulated on the top of the crosspieces of the lower plane, so that it falls by gravity out of the chamber.

2. Chamber according to claim 1, wherein, seen from the side, the crosspieces are disposed in staggered rows, the edges of the crosspieces of the upper plane partially overlapping the crosspieces of the lower plane.

3. Chamber according to claim 2, wherein the crosspieces of the upper plane are perforated.

4. Chamber according to claim 2, wherein said chamber has two slides, the width of which is equal to half that of the base, and the two slides are movable in opposite directions.

5. Chamber according to claim 4, wherein the means of activating said slides consist of a first cable which connects their transverse edges directed from one and the same side, said first cable passing over a series of pulleys, at least one of which is a driving pulley, and a second cable which connects their transverse edges opposite to the first ones, said second cable passing over a series of return pulleys, so that, by activation of the driving pulley, one of the slides moves in one direction, while the second moves in the opposite direction.

6. Chamber according to claim 5, wherein said activation means comprise means capable of always placing the two ends of the cable, respectively attached to the first slide and the second slide, under tension.

7. Chamber according to claim 1, wherein the crosspieces of the upper plane are perforated.

8. Chamber according to claim 7, wherein said chamber has two slides, the width of which is equal to half that of the base, and the two slides are movable in opposite directions.

9. Chamber according to claim 8, wherein the means of activating said slides consist of a first cable which connects their transverse edges directed from one and the same side, said first cable passing over a series of pulleys, at least one of which is a driving pulley, and a second cable which connects their transverse edges opposite to the first ones, said second cable passing over a series of return pulleys, so that, by activation of the driving pulley, one of the slides moves in one direction, while the second moves in the opposite direction.

10. Chamber according to claim 9, wherein said activation means comprise means capable of always placing the two ends of the cable, respectively attached to the first slide and the second slide, under tension.

11. Chamber according to claim 1, wherein said chamber has two slides, the width of which is equal to half that of the base, and the two slides are movable in opposite directions.

12. Chamber according to claim 11, wherein the means of activating said slides consist of a first cable which connects their transverse edges directed from one and the same side, said first cable passing over a series of pulleys, at least one of which is a driving pulley, and a second cable which connects their transverse edges opposite to the first ones, said second cable passing over a series of return pulleys, so that, by activation of the driving pulley, one of the slides moves in one direction, while the second moves in the opposite direction.

13. Chamber according to claim 12, wherein said activation means comprise means capable of always placing the two ends of the cable, respectively attached to the first slide and the second slide, under tension.

14. Chamber according to claim 1, wherein said chamber has a carriage movable longitudinally, capable of receiving said mixture and distributing it uniformly over said base.

15. Chamber according to claim 14, wherein said carriage bears a series of fingers directed downward, capable of levelling the layer of mixture discharged on said base.

16. Chamber according to claim 15, wherein said series of fingers is provided swinging, so as to be able to be retracted at the end of the chamber.

17. Installation for drying animal excrement, notably poultry droppings, comprising:

means for mixing fresh excrement with dry excrement;

a drying chamber in accordance with claim 1;

means of blowing air into said chamber, through said base.

* * * * *